US005109633A

United States Patent [19]

Durnil

[11] Patent Number: 5,109,633

[45] Date of Patent: May 5, 1992

[54] WORKPEICE TUMBLING AND CONVEYING APPARATUS

[75] Inventor: Michael W. Durnil, Louisville, Ky.

[73] Assignee: Carrier Vibrating Equipment, Inc., Louisville, Ky.

[21] Appl. No.: 664,844

[22] Filed: Aug. 9, 1990

[51] Int. Cl.[5] ..... B24B 31/00

[52] U.S. Cl. ..... 51/163.1; 51/164.1

[58] Field of Search ..... 51/163.1, 164.1, 7, 51/17, 164.5

[56] References Cited

U.S. PATENT DOCUMENTS 2,934,202 4/1960 Roder ..... 51/163.1 X
3,608,243 9/1971 Ferrara ..... 51/163.1 X
3,991,524 11/1976 Ferrara ..... 51/163.1

*Primary Examiner*—M. Rachuba
*Attorney, Agent, or Firm*—Jon C. Winger

[57] ABSTRACT

A vibratory tumbling and conveying apparatus for surface treating workpieces by tumbling the workpieces in a vibrating bed of surface treating media. The apparatus comprises an elongated housing having an arcuate bottom wall concaving facing the interior of the housing. A vibratory generating device is structurally associated with the housing and generates a vibratory force imparted to the housing comprising a force couple component having a moment constantly varying in magnitude between zero and a maximum, and a linear component constantly varying in magnitude between a maximum and zero. The magnitude of the force couple component and the magnitude of the linear force component vary inversely to one another. The vibrating force imparted to the housing causes points on the concave side of the arcuate surface to move in an ellipical path having its major axis disposed at an acute angle to the imaginary line tangent to the arcuate surface at the point.

29 Claims, 10 Drawing Sheets

WORKPEICE TUMBLING AND CONVEYING APPARATUS

BACKGROUND OF THE INVENTION

The invention relates to tumbling apparatus, and more particularly to a tumbling apparatus having a vibratory generating device which causes the housing of the tumbling apparatus to move in an elliptical path.

Tumbling apparatus are known in the art. Various examples of known tumbling apparatus are shown in the following U.S. Patents.

U.S. Pat. No. 3,157,004 issued on Nov. 17, 1964 to A. Muusschoot is directed to a vibrating burnishing machine which has a frame resiliently mounted on springs or air cushions a floor or base, and a container having an arcuate bottom having an axle or trunions extending from opposite end walls mounted in bearings attached to the frame. A vibration generator device is mounted to the container for generating a linear vibratory force inclined to the horizontal along an axis passing interiorly of the container through the trunions to vibrate the container in a straight path.

U.S. Pat. No. 3,552,068 issued on Jan. 15, 1971 to H. G. VanFossen is directed to a vibrator construction for the surface treatment of articles which includes an elongated horizontal container for media and articles. The container is resiliently supported on a base member by springs. A vibratory generating device is mounted to the housing and includes two parallel shafts located to opposite lateral sides of the housing at about the same plane as the center of gravity of the housing holding the media and articles. Eccentric weights are connected to the shafts. The eccentric weights on the two shafts are rotated in the same direction and impart a vibrational motion to all points within the container which is orbital and of the same amplitude and direction as the eccentric weights.

U.S. Pat. No. 3,812,625 issued on May 28, 1974 to Wayne L. Olson is directed to a vibratory rock polisher having a base and a cylindrical container for the media and rocks mounted on the base by spring straps secured to the base at both ends. A U-shaped container receiving member is attached to the string straps between the ends of the spring straps, and a vibrator is attached to the U-shaped container receiving member. The container is removably received in the receiving member and is vibrated in a vertical rocking motion.

U.S. Pat. No. 3,604,555 issued on Sep. 14, 1971 to Gerald Cowper is directed to a vibratory conveyor having a horizontal cylindrical member with elongated troughs secured to the outside thereof along which troughs material is conveyed. The cylindrical member is supported above a base on coil springs. The conveyor also includes two vibrator motors with eccentric attached to the drive shaft of the motor. The vibratory motors are driven in opposite directions. One of the vibrator motors are mounted to the top of the horizontal cylindrical member and the other vibrator motor is mounted to the underside of the cylindrical member directly beneath the top vibrator motor. The vibrator motors are oriented with the axes of the drive shafts at an angle to the longitudinal axis of the cylindrical member in horizontal planes so as to produce a helical movement imparted to the cylindrical member along the longitudinal axes of the cylindrical member.

U.S. Pat. No. 3,608,243 issued on Sep. 28, 1971 to A. K. Ferraro is directed to a vibratory finishing machine of the continuous flow type includes a horizontal elongated trough for containing workpieces and media supported on a base by helical springs. Two mechanical vibrators are rigidly attached to and suspended beneath the horizontal trough. Each vibrator includes a shaft and eccentric weight. The two mechanical vibrators are oriented with their shafts in end-to-end relationship and with their shafts coupled together so that they are driven in phase. The vibrators impart a spiral orbital motion or toroidal movement to the trough in the longitudinal direction of the trough but at an angle to the longitudinal axis of the trough.

U.S. Pat. No. 3,769,758 issued on Jun. 28, 1971 to Joseph McDonald is directed to a vibratory stone polisher having a horizontal cylindrical barrel for containing the stones and media. The barrel is supported in a cradle bracket which is supported by a resilient leaf spring attached to one side of the cradle bracket. The vibratory stone polisher further includes a pivotal arm which is vibrated in a vertical plane by an electro-magnetic coil. The distal end of the pivotal arm is attached to the barrel cradle bracket to the opposite side thereof from the leaf spring. The barrel is thusly moved in an arcuate path in a vertical plane centered at the attachment of the cradle bracket to the leaf spring.

U.S. Pat. No. 4,499,692 issued on Feb. 19, 1985 to Gunther Balz is directed to a dual motion vibratory finishing machine. The machine has a horizontal semi-cylindrical housing formed by two concavely facing halves attached together by a resilient connector for containing media and workpieces. The housing is attached at its bottom side to a horizontal base plate which is supported over a stand by coil springs. A first plate extends between the housing and horizontal base plate to one lateral side of the housing, and a second plate extends between the housing and horizontal base plate to the opposite lateral side of the housing. A first vibratory motor is mounted to the first plate and a second vibratory motor is mounted to the second plate. The first vibratory motor is operated to rotate in a counter-clockwise direction to impart a clockwise orbital motion to the media in the trough adjacent the first motor, and the second motor so that the motions of the two bodies of media impinge upon each other in the center area of the housing.

U.S. Pat. No. 4,709,507 issued on Dec. 1, 1987 to Albert Musschoot is directed to a tumbling apparatus which includes a horizontal cylindrical container for containing workpieces and media. The container is carried on a frame is resiliently supported on a foundation by, for example, coil springs. A vibratory generator device having a motor with a double-ended drive shaft and eccentric weights mounted on each end of the double-ended drive shaft is mounted to one lateral side of the container with the double-ended drive shaft substantially paraliel to the longitudinal axis of the container so as to produce a linear forces along a linear path passing exteriorly of the container displaced not only from the central axis of the container but also from the center of gravity of the container, the linear path of the linear vibratory forces passing on the side of the center of gravity removed from the central axes to cause points on the curved surface of the container to rotate along an arcuate path basically segments of circles, not conforming to the curvature of the curved material supporting surface of the container, and which segments of circles all have a common center of rotation located at a fixed position displaced from the central axis and from the center of gravity on the other side of the central axis from the center of gravity. The common center of rotation of the circle segments is at fixed virtually point location during the operation of the tumbling apparatus.

U.S. Pat. No. 4,527,747 issued on Jul. 9, 1985 is directed to a vibratory apparatus for treating goods or workpieces which includes a generally horizontal cylindrical container for containing workpieces and media. The container is above a foundation by coil springs. Vibration generators are mounted to one lateral side of the container so as to produce a resultant linear force passing interiorly of the container displaced not only from the central axis of the container but also from the center of gravity of the container, the linear path of the resultant linear force passing on the side of the center of gravity removed from the central axis. Accordingly, a resulting action is created by the vibrating rotational movements imparted to the container result in a revolving motion of the media and goods being treated whereby the goods, and therefore, also the media, are exposed to higher vertical acceleraton in the upper zone than in the lower zone of the container and, accordingly, the resultant linear force effective on the container, and therefore, the media and goods, has a lower angular inclination relative to the horizontal in the lower zone of the container than in the upper zone or the container.

SUMMARY OF THE INVENTION

The present invention provides a workpiece tumbling and conveying apparatus which provide a more efficient tumbling action than the various tumbling devices of the prior art.

The present invention provides a tumbling apparatus which includes a vibratory generating device imparting an elliptical path of motion to the tumbler housing which imparts a velocity and acceleration to the media in the housing directed inwardly of the housing providing greater frictional adhesion of the media to the housing wall with the result that the media climbs higher on the housing side wall before the media is pitched-off and away from the housing wall in an inward direction of the housing than can be accomplished by the prior-art tumbling apparatus and also at a greater pitch-off velocity than can be accomplished by the prior-art tumbling apparatus.

More particularly, the present invention provides a workpiece tumbling and conveying apparatus comprising an elongated generally horizontal housing for containing the workpieces and a surface treating media, the housing having an arcuate bottom wall concavely facing toward the interior of the housing, an inlet opening proximate one end, and an outlet opening proximate the other end; a base member; resilient means for resiliently supporting the housing avoe the base member; vibratory generating means structurally associated with the elongated housing for generating a vibratory force and imparting the vibratory force to the housing, the vibratory force comprising a force couple component continuously varying in magnitude between a zero value and maximum value, and a linear component continuously varying in magnitude between a maximum value and a zero value, the magnitude of the force couple component varying inversely the magnitude of the linear force component such that at the instant that the magnitude of the force couple component is zero, and at the instant the magnitude of the force couple is at a maximum value the magnitude of the linear force component is zero.

BRIEF DESCRIPTION OF THE DRAWINGS

A better understanding of the present invention will be had upon reference to the following discussion in conjunction with the accompanying drawings in which like numerals refer to like parts throughout the views and wherein.

DETAILED DESCRIPTION OF THE PREFERRED EMBODIMENTS

Figure 1:
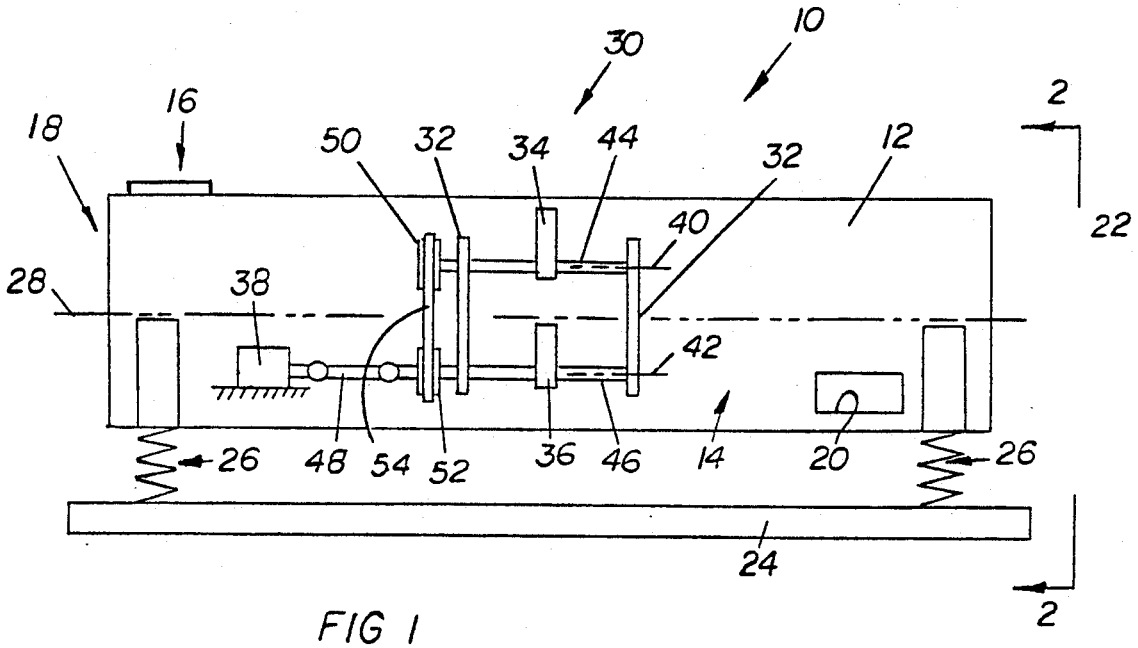
FIG. 1 is a schematic side view of a tumbling and conveying apparatus of the present invention.
Figure 2:
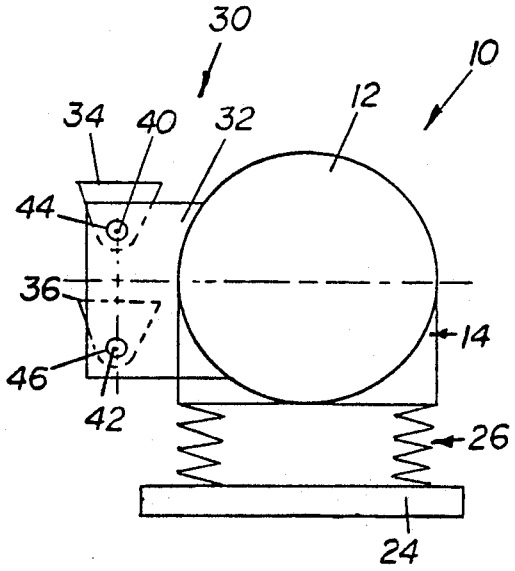
FIG. 2 is an end view of the tumbling and conveying apparatus of FIG. 1 as seen in the direction of arrows 2—2 in FIG. 1.

With reference to FIGS. 1 and 2, there is shown a tumbling and conveying apparatus, generally denoted as the numeral 10, of the present invention. The apparatus 10 is shown as comprising a generally horizontal elongated housing 12 for containing workpieces and any workpiece surface treating media which may be required to surface treat the workpieces. The housing 12 is illustrated as being cylindrical, however, the housing 12 could be various other shapes, such as semi-cylindrical or elliptical in transverse cross-section, which provides a housing bottom wall, generally denoted as the numeral 14, which is arcuate and concavely faces the interior of the housing 12. The housing 12 further includes a media and workpiece inlet opening 16 proximate one end, or upstream end 18, of the housing 12 and a media and workpiece outlet opening 20 proximate the other end, or downstream end 22, of the housing 12. The elongated housing 12 is supported above a base member 24 by resilient means, generally denoted as the numberal 26, such as a plurality of coil springs, providing for unrestrained motion of the housing 12 except for the dampening provided by the resilient means 26. The housing 12 can be slightly declined from the upstream housing end 18 to the downstream housing end 20 such that the housing longitudinal axis 28 is declined to improve the flow of media and workpieces along the length of the elongated housing 12 from the upstream housing end 18 toward the downstream housing end 20 to the outlet 20. Vibratory generating means, generally denoted as the numeral 30, is structurally associated with the housing 12 for generating a vibratory force and imparting the vibrating force to the housing 12 to vibrate the workpieces and media in the housing 12.

With continued reference to FIGS. 1 and 2, the vibratory generating means 30 is mounted to one side of the housing 12 by a bracket 32. Further, the vibrating generating means 30 comprises a first eccentric rotatable weight 34 and a second eccentric rotatable weight 36 both operatively associated with a drive motor 38 so that the first and second weights counter rotate. That is, as seen in FIG. 2, the first eccentric weight 34 is rotated in a counter-clockwise direction and the second eccentric weight 36 is rotated in a clockwise direction. The first weight 34 is located above and substantially in a common first plane with the second weight 36 the longitudinal axis 28 of the housing 12 the axis of rotation 40 of the first eccentric weight 34 is spaced from and parallel to the axis of rotation 42 of the second eccentric weight 36 and the axis of rotation 40 of the first eccentric weight 34 is in alignment with the axis of rotation 42 of the second eccentric weight 36 in a common substantially vertical second plane spaced from the side of the housing 12 (which second plane is substantially parallel to the longitudinal axis 28 of the housing 12). Therefore, the first plane of the eccentric weights 34, 36 is substantially perpendicular to the second plane of the axes of rotation 40, 42. Toward this objective, a first axle 44 defining the axis of rotation 40 of the first eccentric weight 34 is journal mounted to the bracket 32 in spaced-apart relationship from the side of the housing 12, substantially parallel to the longitudinal axis 28 of the housing and at an elevation above the elevation of the longitudinal axis 28 of the housing 12, and a second axle 46 defining the axis of rotation 42 of the second eccentric weight 36 is journal mounted to the bracket 32 in spaced-apart relationship from the side of the housing 12, substantially parallel to the longitudinal axis 28 of the housing and at an elevation below the elevation of the longitudinal axis 28 of the housing 12. The first axle 44 and second axle 46 lay in the common second vertical plane, and are equally spaced apart to either side of a horizontal plane containing the longitudinal axis of the housing 12. The first eccentric weight 34 is mounted to the first axle 44 for rotation therewith, and the second eccentric weight 36 is mounted to the second axle 46 for rotation therewith.

Figure 3:
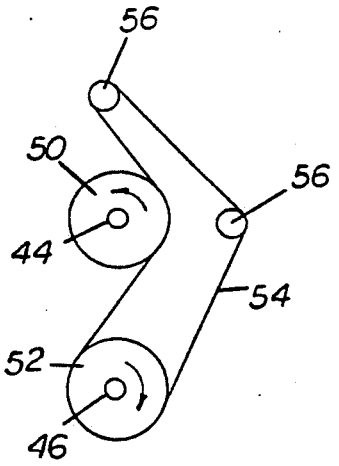
FIG. 3 is a schematic representation of a drive system of the tumbling and conveying apparatus of FIGS. 1 and 2.

The motor 38 can be operatively associated with the first and second weights 34 and 36, respectively, and more particularly to the first and second axles 44 and 46, respectively, to counter-rotate the axles 44, 46 and, therefore, the eccentric weights 34 and 36, by various means. For example, with reference to FIGS. 1 and 3, the output shaft of the motor 38 can be interconnected to the second axle 46 by a coupling shaft 48 with appropriate universal joints or resilient couplers interconnecting one end of the coupling shaft 48 to the motor output shaft and interconnecting the other end of the coupling shaft 48 to the end of the second axle 46. A first sheave 50 is concentrically mounted on the first axle 44, and a second sheave 52 is concentrically mounted on the second axle 46. A drive belt 54 is trained about the second sheave 52 and has its outside surface in abutment with the first sheave 50. Appropriate idler tensioning sheaves 56 are provided to maintain a proper tension on the drive belt 54. This drive arrangement provides for rotating the first sheave 50, and therefore the first eccentric weight 34 in one rotational direction, for example, a clockwise direction as seen in FIG. 3, and for rotating the second sheave 52, and therefore the second eccentric weight 36 in the opposite rotational direction, for example a counter-clockwise direction as seen in FIG. 3.

Figure 4:
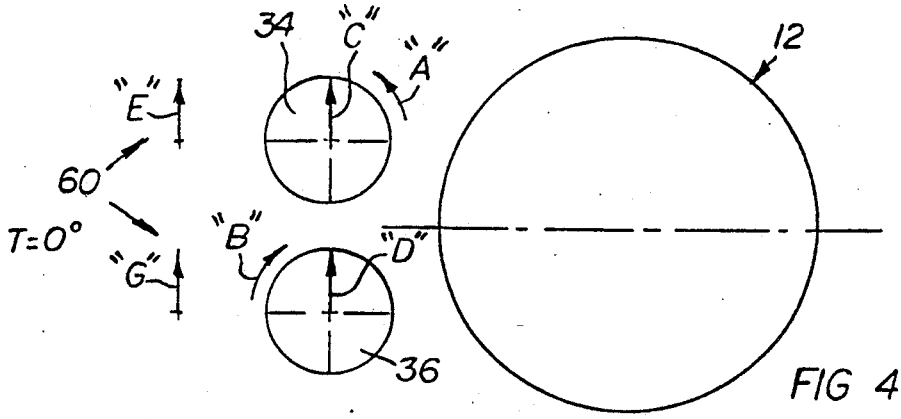
FIGS. 4 through 27 sequentially schematically illustrate the vibratory force comprising a force couple component and a linear force component generated by the vibratory generating device of the tumbling and conveying apparatus of FIGS. 1 and 2 and imparted to the housing of the tumbling and conveying apparatus of FIGS. 1 and 2.
Figure 5:
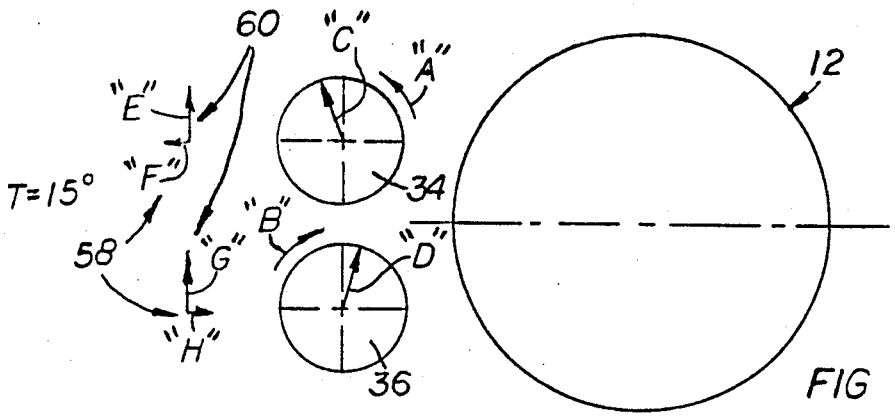
Figure 6:
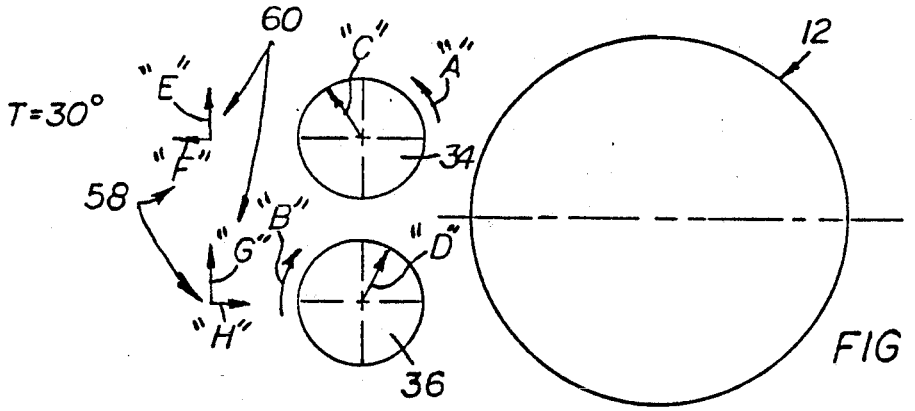
Figure 7:
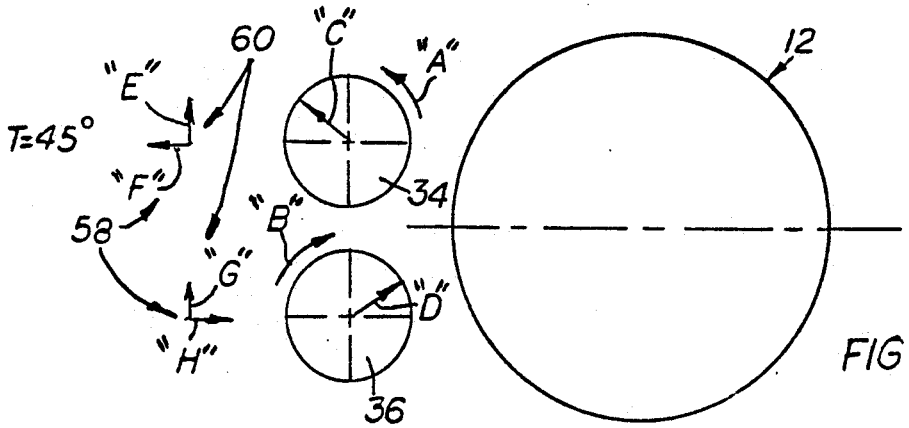
Figure 8:
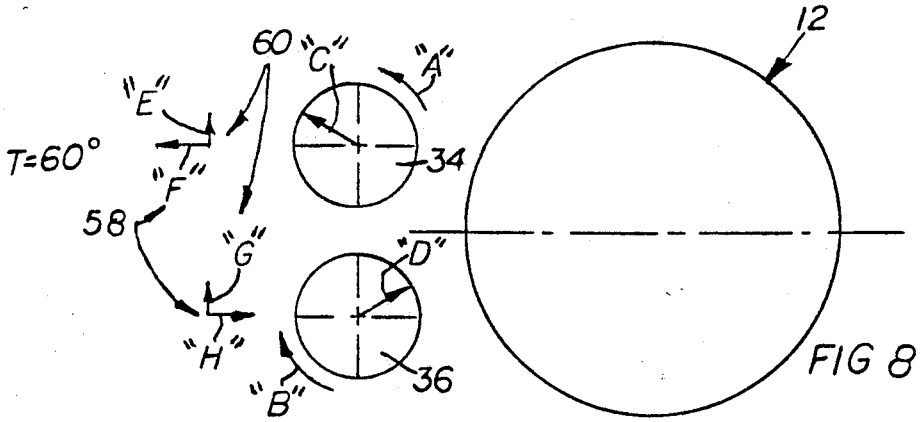
Figure 9:
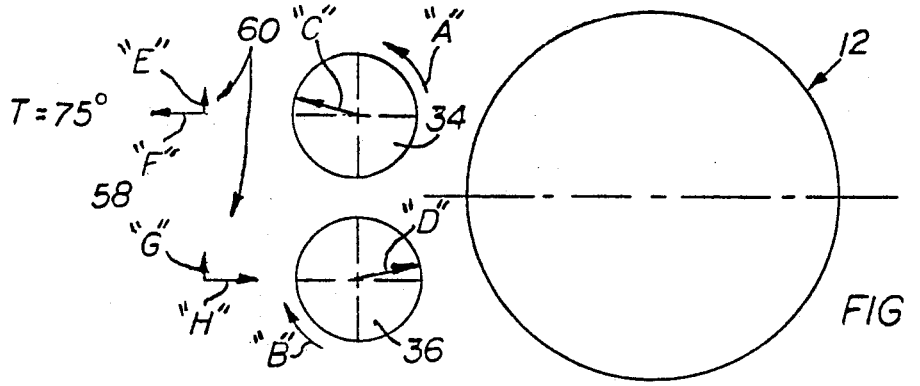
Figure 10:
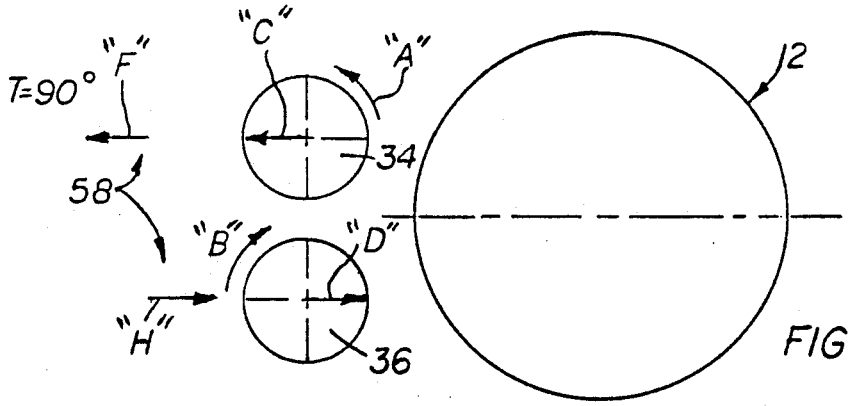
Figure 11:
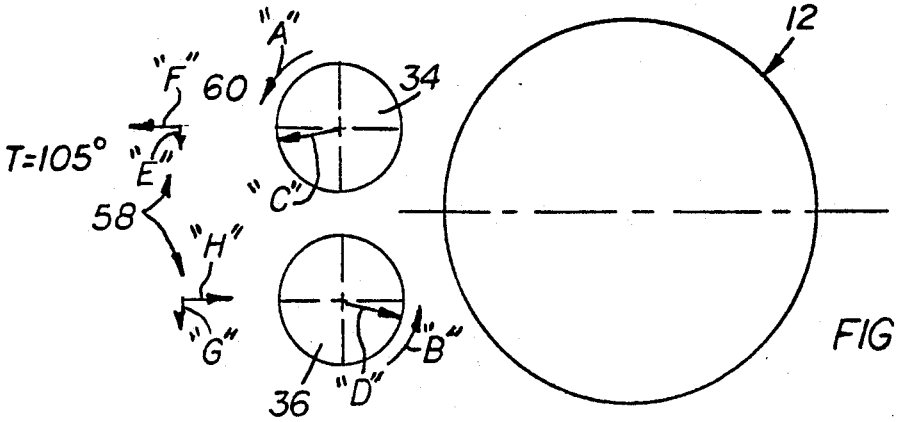
Figure 12:
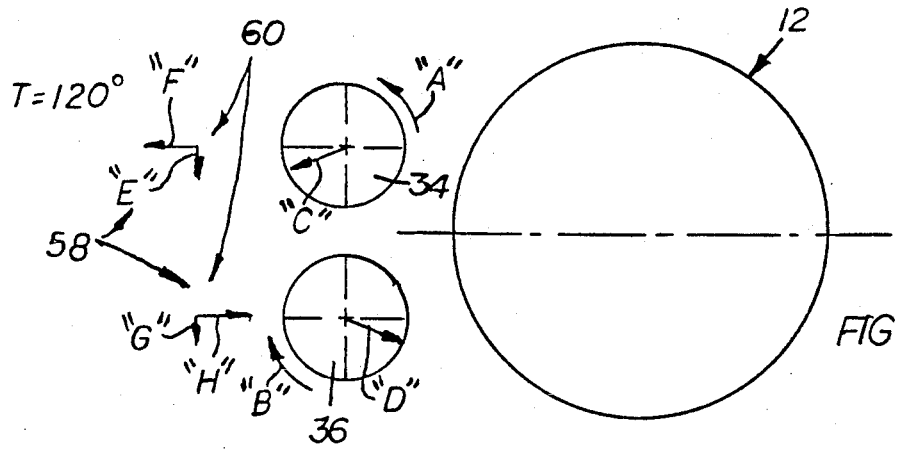
Figure 13:
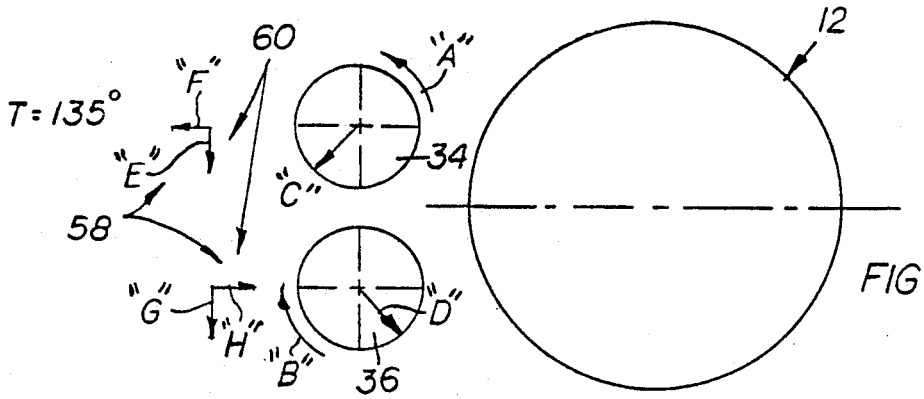
Figure 14:
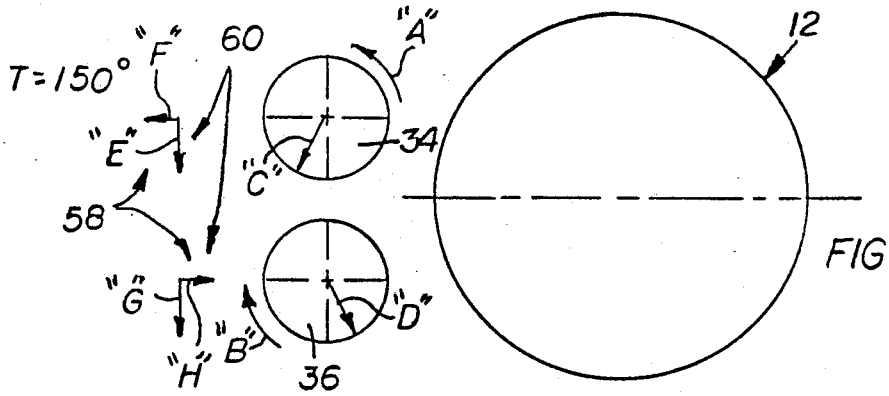
Figure 15:
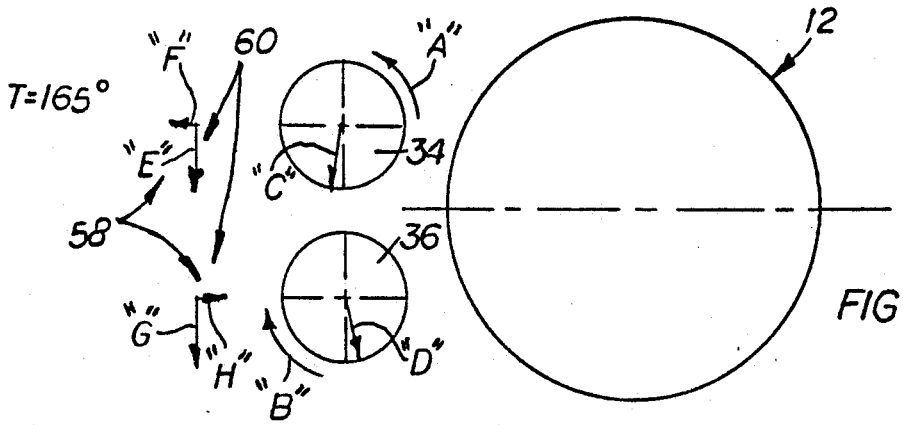
Figure 16:
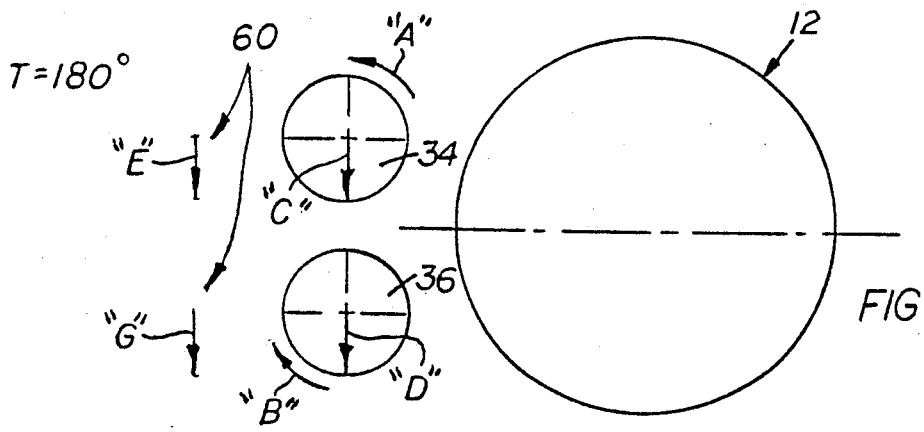
Figure 17:
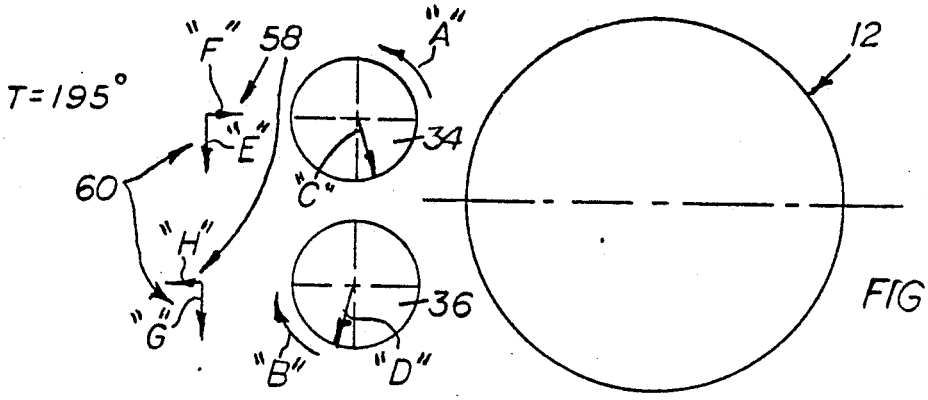
Figure 18:
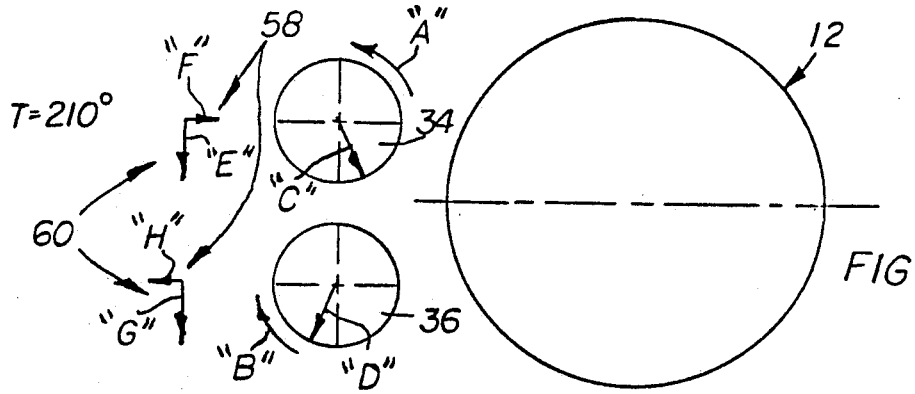
Figure 19:
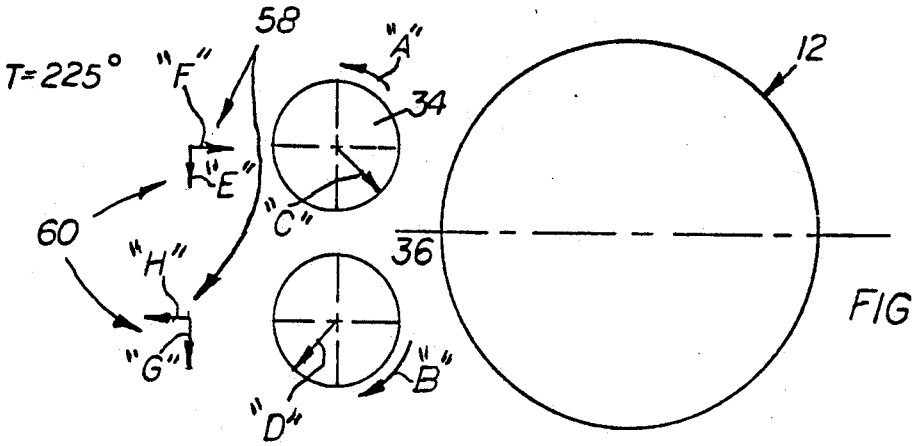
Figure 20:
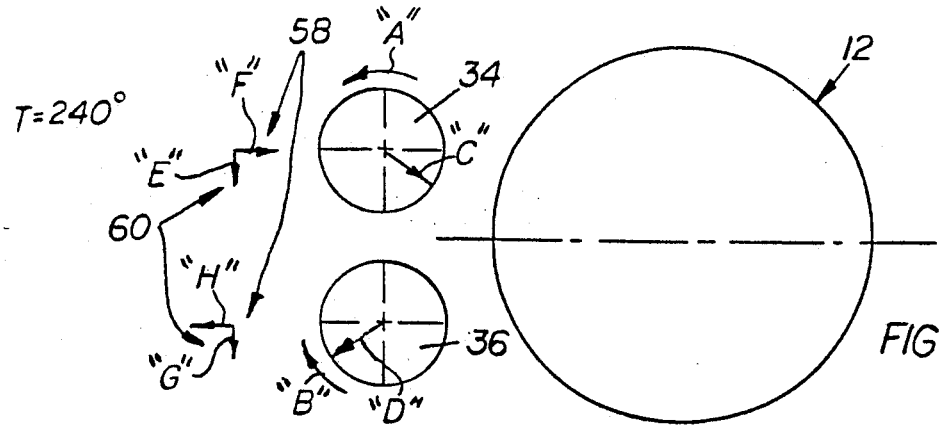
Figure 21:
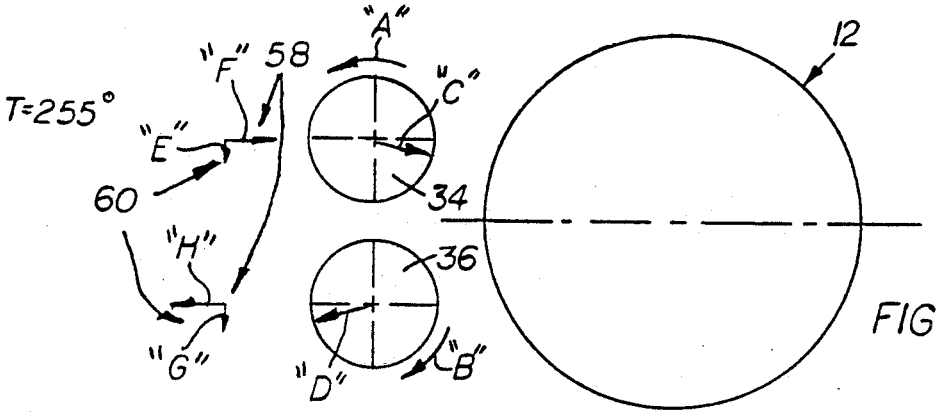
Figure 22:
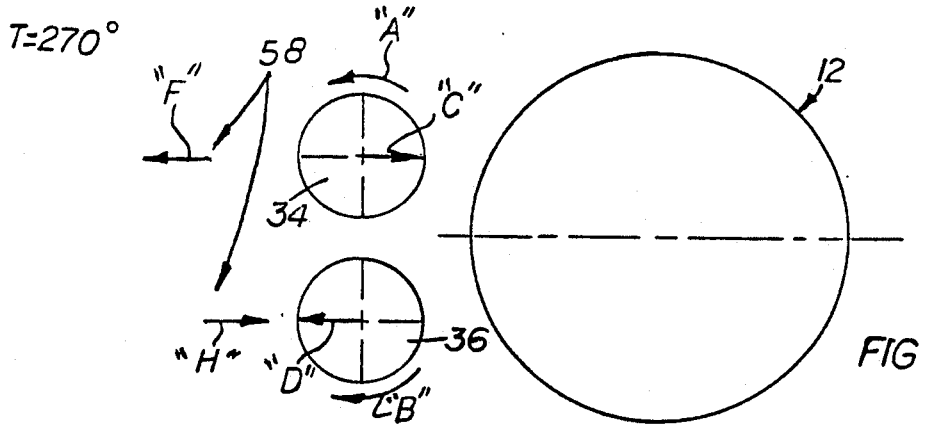
Figure 23:
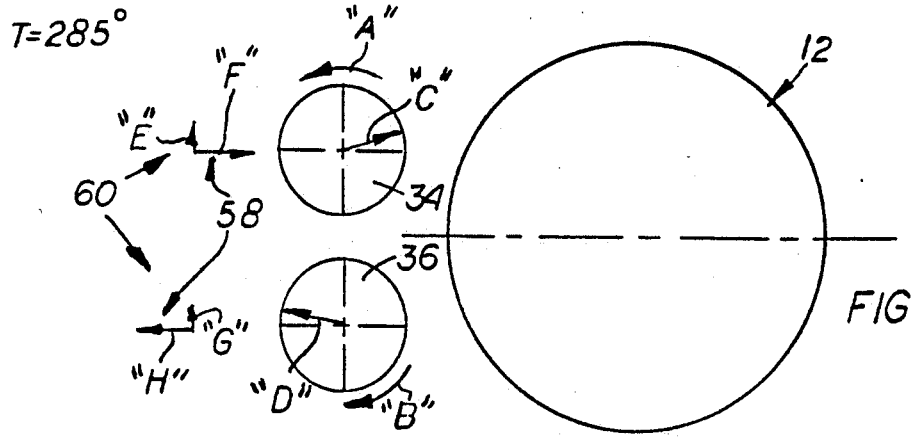
Figure 24:
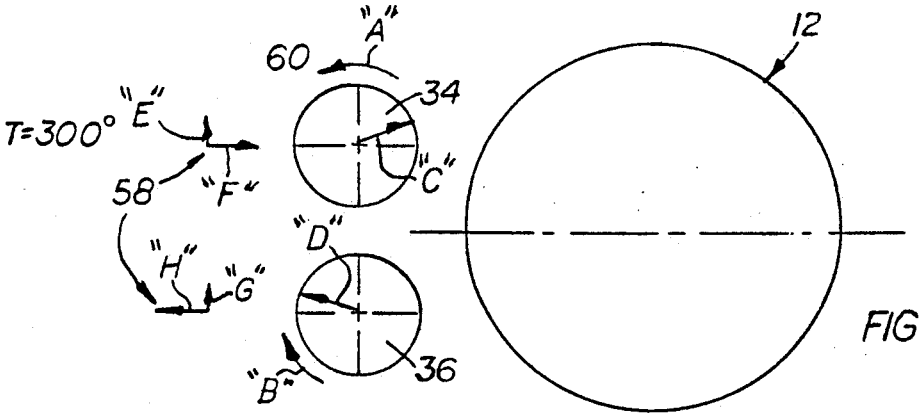
Figure 25:
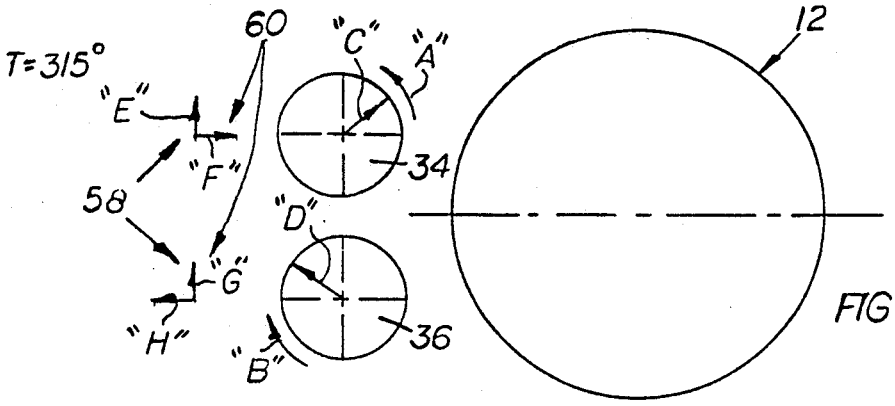
Figure 26:
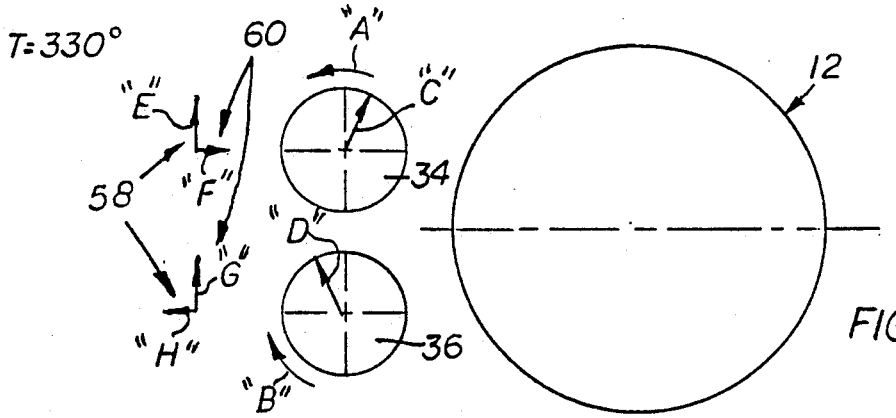
Figure 27:
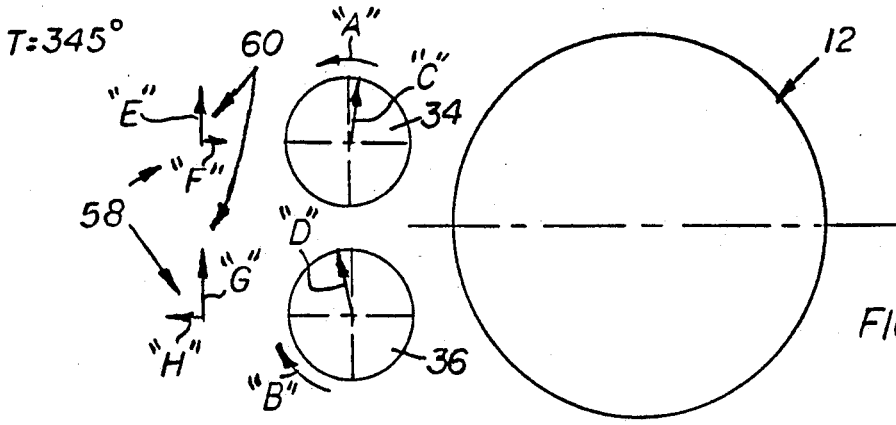

As can be best visualized by reference to FIGS. 4 through 27, the counter rotating first eccentric weight 34 and second eccentric weight 36 rotating in the common first plane cooperate to generate a resultant vibratory force having a force couple component, generally denoted as the numeral 58, and a linear force component, generally denoted as the numeral 60. FIGS. 4 through 27 illustrate the force couple component 58 and linear force component 60 of the vibratory force generated by the first and second eccentric weights 34 and 36 in vectorial format and sequentially at intervals of 15° of rotation during one rotational cycle of the first and second eccentric weights 34 and 36. As can be seen by sequentially viewing FIGS. 4 through 27, the magnitude of the force couple component 58 varies continuously from a zero value to a maximum value, and the magnitude of the linear force component 60 also varies continuously from a maximum value to a zero value during each rotational cycle of the first and second eccentric weights 34 and 36. More particularly, the magnitude of the force couple 58 varies inversely to the magnitude of the linear force component 60 such that at the instant in time that the magnitude of the linear force component 60 is at a maximum value the magnitude of the force couple 58 is zero, and at the instant in time that the magnitude of the force couple 58 is at a maximum value, the magnitude of the linear force component 60 is zero. In FIGS. 4 through 27, arcuate directional arrow "A" indicates the rotational direction of the first eccentric weight 34, the arcuate directional arrow "B" indicates the rotational direction of the second eccentric weight 36, arrow "C" is the vector of the force generated by the first eccentric weight 34 as it rotates, arrow "D" is the vector of the force generated by the second eccentric weight 36 as it rotates, arrow "E" is the vertical component of the force vector "C", arrow "F" is the horizontal component of the force vector "C", arrow "G" is the vertical force component of the force vector "D", and arrow "H" is the horizontal force component of the force vector "D". The vertical force vector components "E" and "G" are additive and define the linear force vector 60 generated by the rotating first and second eccentric weights 34 and 36, and the horizontal force vector components "F" and "H" define the force couple component 58 generated by the rotating first and second rotating weights 34 and 36. With reference to FIG. 4, at the time of rotation of the eccentric weights 34, 36 arbitarily referred to hereinafter at a time equal to zero during the rotation of the weights 34, 36, the linear force component 60 defined by the vertical force components "E" and "G" is at a maximum magnitude in an upward direction and the force couple component 58 is at a magnitude of zero. With reference sequentially t FIGS. 5 through 10, as the eccentric weights 34, 36 continue rotating, the magnitude of the linear force component 60 of the vibratory force continuously diminished in an upward direction and the magnitude of the force couple component 58 continuously increases in a counter-clockwise sense of rotation until the instant in time corresponding to 90° of rotation of the weights 34 and 36 from the time equal to zero (see FIG. 10) when the magnitude of the force couple component is at a maximum value in a counterclockwise sense of rotation, and the magnitude of the linear force component 60 is zero. With reference to FIGS. 11-16, as the eccentric weights 34, 36 continue rotating, the magnitude of the linear component 60 of the vibrating force continuously increases in a downward direction and the magnitude of the force couple component 58 continuously diminishes in a counterclockwise sense of direction until the instant in time corresponding to 180° of rotation of the weights 34 and 36 from the time equal to zero (see FIG. 16) when the magnitude of the linear force component 60 is at a maximum value in the downward direction and the magnitude of the force couple component 58 is zero. With reference to FIGS. 17 through 23, as the eccentric weights 34 and 36 continue rotating, the magnitude of the linear force component 60 of the vibrating force continuously diminishes in the downward direction and the magnitude of the force couple component 58 continuously increases in a clockwise sense of rotation until the instant in time corresponding to 270° of rotation of the weights 34 and 36 from the time equal to zero (see FIG. 22) when the magnitude of the force couple component is at a maximum value in a clockwise sense of rotation, and the magnitude of the linear force component is zero. With reference to FIGS. 23 through 27 and FIG. 4, as the eccentric weights 34 and 36 continue rotating, the magnitude of the linear force component continuously increases in an upward direction and the magnitude of the force couple component 58 continously diminishes in a clockwise sense of rotation until the instant in time corresponding to 360° of rotation of the weights 34 and 36 from the time equal to zero (see FIG. 4) when the magnitude of the linear force component 60 is at a maximum in the upward direction, and the magnitude of the force couple component 58 zero. It should be noted that the linear force component 60 of force couple component 58 in the plane in which the force couple 60 acts, and that the lines of action of the horizontal force vectors "F" and "H" defining the force couple component 58 are directed across the housing 12 and, as shown, are equally spaced to either side of a diameter or transverse centerline of the housing 12.

Figure 28:
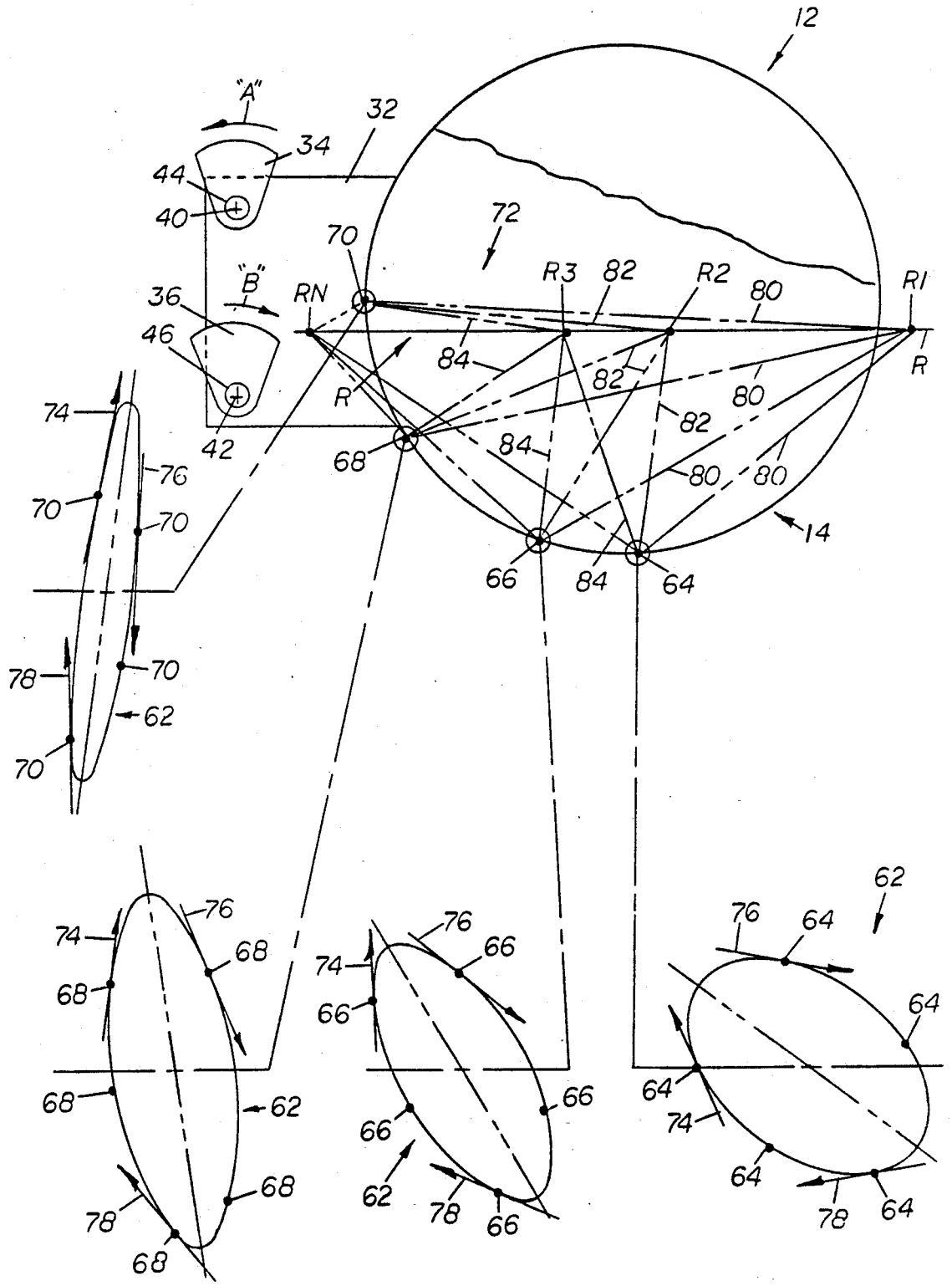
FIG. 28 is an enlarged schematic end view of the tumbling apparatus of FIG. 1 similar to that of FIG. 2, and illustrating the motion imparted to the housing of the tumbling and conveying apparatus by the vibratory force generated by the vibratory generating device shown in FIGS. 3–26.

FIG. 28 depicts the effect on the housing 12, and, therefore, also the effect on the workpieces and media in the housing 12, caused by the vibratory force comprised of the force couple component 58 and linear force component 60 generated by the vibratory generating means 30 on the housing 12. As depicted in FIG. 28, all of the various points or locus on the circumference of the bottom wall 14 of the housing 12 each move in an elliptical path, generally denoted as the numeral 62, having its major axis inclined to the horizontal. For the sake of clarity, the elliptical paths are illustrated in enlarged format and for the sake of brevity of description only four different points, denoted as the numerals 64, 66, 68 and 70, spaced apart from each other circumference on the concave surface of the housing bottom wall 14 are depicted. It is to be understood that the points 64, 66, 68, 70 are representative of all points on the concave arcuate surface of the housing bottom wall 14. Each point 64, 66, 68, and 70 moves in an elliptical path. The elliptical path of each of these points has its major axis at a different inclined angle relative to an imaginary tangent line (not shown) which is tangent to the arcuate housing bottom wall 14 at that point 64, 66, 68, 70. Further, the inclination of the elliptical path, relative to the horizontal, of each point on the concave surface of the housing bottom wall 14 progressively closer to the vibratory generating means 30, or further up the side of the arcuate housing bottom wall 14, increases. As shown, the elliptical paths of motion have a clockwise sense of rotation. The media, generally denoted as the numeral 72, in the housing 12 is caused to also move or flow circumferentially across and climb upwardly of the arcuate housing bottom wall 14 in a direction toward the vibratory generating means 30 due to the clockwise elliptical paths of motion of the various points on the arcuate housing bottom wall 14. The angle of the major axes of the elliptical paths of motion of the various points or locus along the concave arcuate surface of the arcuate housing bottom wall 14 relative to an imaginary tangent line at each of the points defines the pitch-off angles of the media 72 relative to the arcuate housing bottom wall 14. In this context, it should be noted here, that the major axes of the elliptical paths of motion of all the points or locus on the arcuate surface of the arcuate housing bottom wall 14 are angled inwardly of the housing 12 or toward the interior of the housing 12. This feature provides that all of the media adjacent the concave arcuate housing bottom wall 14 is thrown inwardly of the housing 12 as the housing is vibrated.

With continued reference to FIG. 28, and particularly the enlarged depictions of the elliptical paths 62 of the illustrative points 64, 66, 68, 70, vectors 74, 76, and 78, respectively, further illustrate the instantaneous direction and position of each of the points 64, 66, 68, 70 at three different instants in time during the motion of the points 64, 66, 68, 70 along their respective elliptical paths 62. Imaginary lines 80 drawn perpendicular to the vector 74 of each of the points on the concave surface of the housing bottom wall 14 represented by the points 64, 66, 68, 70 mutually intersect at a single location or common instant center R1, imaginary lines 82 drawn perpendicular to the vector 76 of each of the points on the concave surface of the housing bottom wall 14 represented by the points 64, 66, 68, 70 mutually intersect at another single location or common instant center R2, and imaginary lines drawn 84 perpendicular to the vector 78 of each of the points on the concave surface of the housing bottom wall 14 represented by the points 64, 66, 68, 70 mutually intersect at yet another single location or common instant center R3. All of the infinite number of points on the housing bottom wall 14 have a common instant center at any instant in time, and as the housing is vibrated the instant center (represented by RI through RN at different instants in time) continuously moves back and forth along a generally linear path generally denoted as "R" between locations either side of andoutside of the housing, and extending across the housing 12 as the housing 12 is vibrated.

Figure 29:
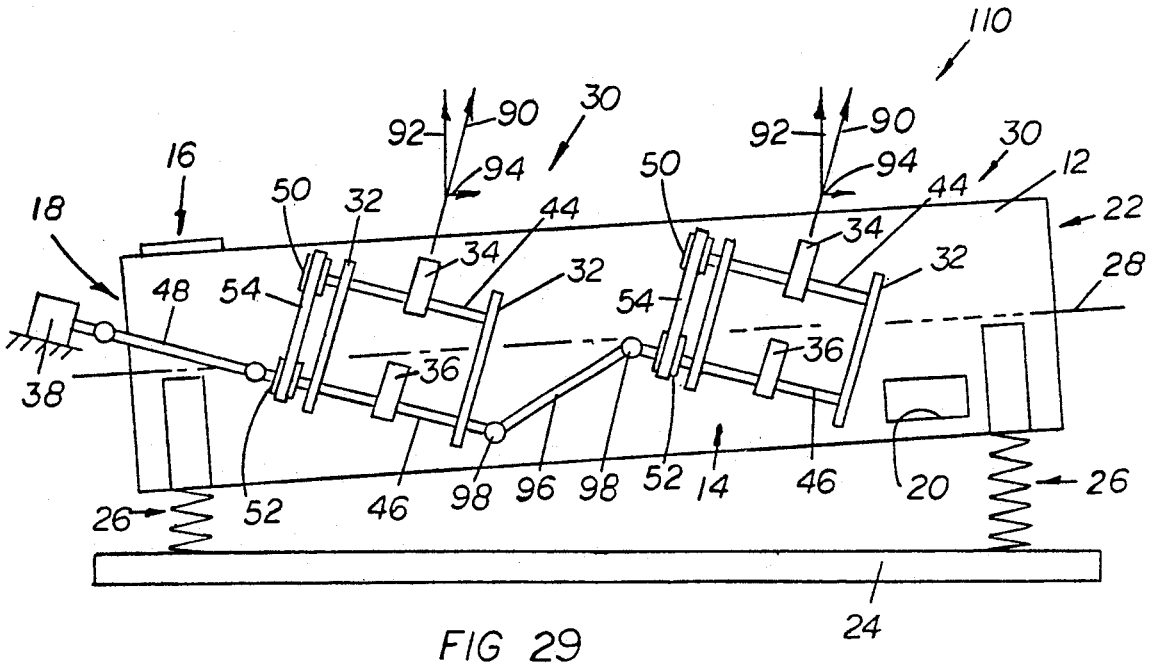
FIG. 29 is a schematic side view of another tumbling and conveying apparatus of the present invention.

FIG. 29 illustrates a side view of another preferred tumbling and conveying apparatus, generally denoted as the numeral 110, which has many features in common with the tumbling and conveying apparatus 10 of FIGS. 1-3. The similar features are denoted by identical numerals and for the sake of brevity, the description of the common features will not be repeated. The housing 12 is inclined from the upstream housing end 18 to the downstream housing end 20 such that the longitudinal axis 28 is inclined to the horizontal. The apparatus 110 employs a plurality of vibratory generating means 30, for example, two vibratory generating means 30 spaced apart from each other in the direction of the longitudinal axis 28 of the housing 12. At least one of the vibratory drive means 30 can be oriented to the vertical to generate a resultant force vector 90 acting at an acute angle to the vertical for providing a conveying force to the media and workpieces in the housing 12 for conveying media and workpieces along the housing 12 from the upstream housing end wall 18 toward the downstream housing end wall 22. However, as shown, each of the two vibratory generating means 30 is oriented with the first eccentric weight 34 and second eccentric weight 36 rotating in a common first plane transverse to the longitudinal axis 28 of the housing 12 at an acute included angle to the vertical tilted toward the housing downstream end 22 so that the common first plane in which the resultant force 90 , comprised of the force couple component 58 and linear force component 60, acts is disposed at the acute angle to the vertical tilted toward the housing downstream end 22. The effect on the media and workpieces in the housing 12 of positioning the vibratory generating means 30 in this orientation is to provide a vertical force component 92 and a horizontal force component 94 of the resultant force 90. The horizontal force component 94 acting on the media and workpieces in the housing 12 provides a conveying force to the media and workpieces in the housing 12 in a direction from the upstream housing end 18 toward the downstream housing end 22. Thusly, the media and workpieces are conveyed along the inclined longitudinal axis 28 of the housing 12.

With continued reference to FIG. 29, both vibratory generating means 30 are driven in unison by a single drive motor 38. This can be accomplished by providing a coupling shaft 96 interconnecting, for example, the second axle 46 of one vibratory generating means 30 to the second axle 46 of the other vibratory generating means 30, with appropriate universal joints or resilient couplers 98 interconnecting the ends of the coupling shaft 96 to the ends of the second axles 46 of the two vibratory generating means 30.

Figure 30:
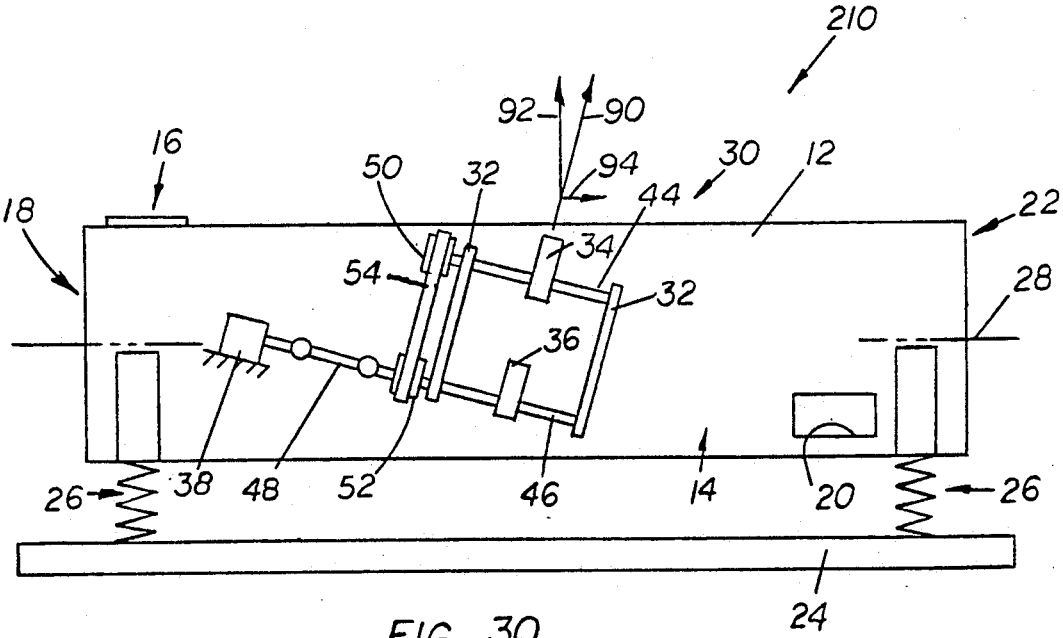
FIG. 30 is a schematic side view of yet another tumbling and conveying apparatus of the present invention.

FIG. 30 illustrates a side view of yet another preferred tumbling and conveying apparatus, generally denoted as the numeral 210, which has many features in common with the tumbling and conveying apparatus 10 of FIGS. 1-3 and also the tumbling and conveying apparatus 110 of FIG. 29. The similar featues are denoted by identical numerals and for the sake of brevity, the description of the common featues will not be repeated. The housing 12 is horizontal, and the vibratory generating means 30 is oriented with the first eccentric weight 34 and second eccentric weight 36 rotating in a common first plane transverse to the longitudinal axis 28 of the housing 12 at an acute included angle to the vertical tilted toward the downstream housing end wall 22 so that the common first plane in which the resultant force 90, comprised of the force couple component 58 and linear force component 60 acts, is disposed at the acute angle to the vertically tilted toward the housing downstream end wall 22. The effect on the media and workpieces in the housing 12 of positioning the vibratory generating means 30 in this orientation is to provide a vertical force component 92 and a horizontal force component 94 of the resultant force 90. The horizontal force component 94 acting on the media and workpieces in the housing 12 provides a conveying force to the media and workpieces in the housing 12 in a direction from the upstream housing end 18 toward the downstream housing end 22. Thusly, the media and workpieces are conveyed along the horizontal longitudinal axis 28 of the housing 12 to the outlet 20. It should be understood that, of course, the apparatus 210 can include a plurality of vibratory generating means 30 similar to the apparatus 110.

Figure 31:
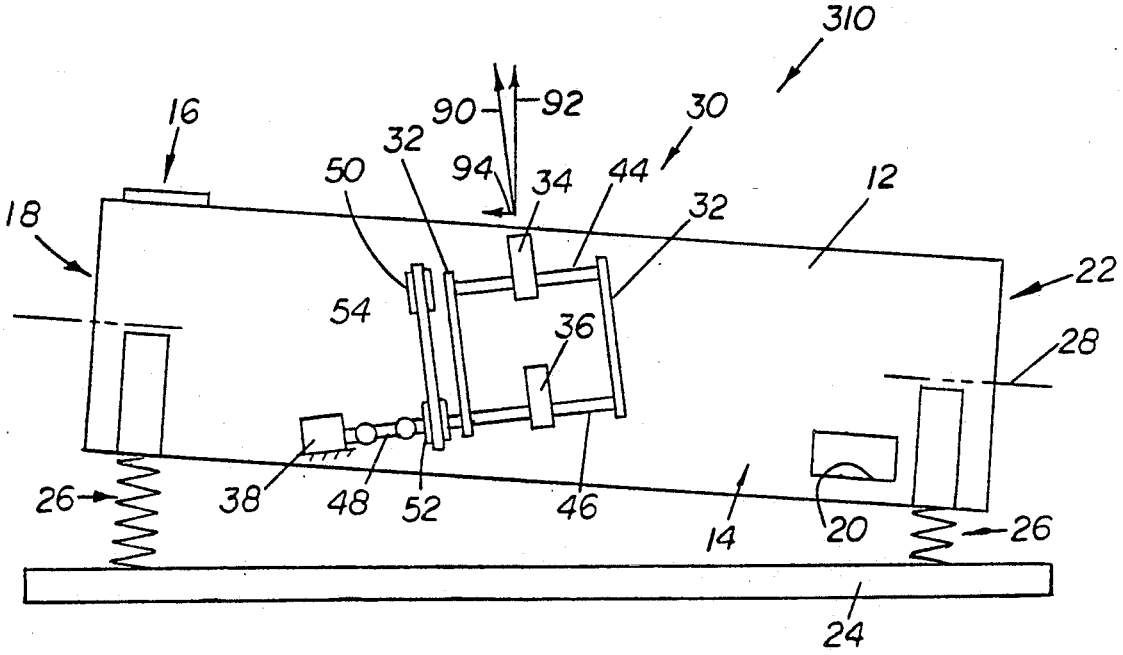
FIG. 31 is a schematic side view of still another tumbling and conveying apparatus of the present invention.

FIG. 31 illustrates a side view of still another preferred tumbling and conveying apparatus, generally denoted as the numeral 310, which has many featues in common with the tumbling and conveying apparatus 10, 110, 210. The similar featues are denoted by identical numerals and for the sake of brevity, the description of the common features will not be repeated. The housing 12 is declined from the upstream housing end 18 toward the downstream housing end 22 so that media and workpieces in the housing 12 are conveyed by gravity toward the downstream housing end wall 22. The vibratory generating means 30 is oriented with the first eccentric weight 34 and second eccentric weight 36 rotating in a plane at an inclined acute angle to the vertical and tilted toward the housing upstream end wall 18 so that the common first plane in which the resultant force 90, comprised of the force couple component 58 and linear force component 60, acts is disposed at an acute angle to the vertical tilted toward the housing upstream end wall 18. The effect on the media and workpieces in the housing 12 of positioning the vibratory generating means 30 in this orientation is to provide a vertical force component 92 and a horizontal force component 94 of the resultant force 90. The horizontal force component 94 acting on the media and workpieces in the housing 12 provides a counter-conveying force to the media and workpieces in a direction toward the upstream housing end 18 so as to retard or slow the conveyance of the media and workpieces from the upstream housing end 18 to the downstream housing end 22 along the declined housing 12. It should be understood that, of course, the apparatus 310 can include a plurality of vibratory generating means 30 similar to the apparatus 10.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

I claim:

1. A workpiece tumbling and conveying apparatus for surface treating and conveying workpieces, comprising:

an elongated generally horizontal housing having an arcuate bottom wall concavely facing toward the interior of the housing, the housing having an inlet proximate one end and an outlet proximate the other end;

a base member;

resilient means for resiliently supporting the housing above the base member; and vibratory generating means structurally associated with the elongated housing for generating a vibratory force and imparting the vibratory force to the housing, the vibratory force comprising a force couple component continuously varying in magnitude between a maximum value and a zero value, and a linear force component continously varying in magnitude between a zero value and a maximum value, the varying magnitude of the force couple component varying inversely to the varying magnitude of the linear force component such that at the instant the magnitude of the linear force component is at a maximum value the magnitude of the force couple component is zero, and at the instant the magnitude of the force couple component is at a maximum value the magnitude of the linear force component is zero, the vibratory force vibrating the housing such that the loci on the arcuate bottom wall of the housing moves in elliptical paths all having a common instant center of motion at any instant in time.

2. The workpiece tumbling and conveying apparatus of claim 1, wherein the linear force component of the vibratory force is perpendicular to the amount of the force couple component of the vibratory force.

3. The workpiece tumbling and conveying apparatus of claim 2, wherein the linear force component of the vibratory force is in the plane in which the force couple acts.

4. The workpiece tumbling and conveying apparatus of claim 3, wherein the lines of action of force vectors defining the force couple component are directed across the housing.

5. The workpiece tumbling and conveying apparatus of claim 4, wherein the lines of action of force vectors defining the force couple component are equally spaced to either side of a diameter of the housing.

6. The workpiece tumbling and conveying apparatus of claim 1, wherein the vibratory force moves each locus on the circumference of the arcuate bottom wall of the housing in an elliptical path, the major axis of each of the elliptical paths being at an inclined angle to an imaginary line tangent to the arcuate bottom wall at that locus.

7. The workpiece tumbling and conveying apparatus of claim 6, wherein the major axes of the elliptical paths of the locus on the circumference of the housing arcuate bottom wall are at different inclined angles relative to the imaginary line therethrough tangent to the arcuate bottom wall.

8. The workpiece tumbling and conveying apparatus of claim 7, wherein the angle of inclination of the major axes of the elliptical paths of the loci on the arcuate bottom wall progressively further up the side of the arcuate bottom wall increases relative to the horizontal.

9. The workpiece tumbling and conveying apparatus of claim 1, wherein the instant center of motion of the loci on the arcuate bottom wall continuously moves back and forth along a generally linear path transversely across the housing as a function of time as the vibratory generating means imparts the vibratory force to the housing.

10. The workpiece tumbling and conveying apparatus of claim 9, wherein the instant center of motion of the loci continuously moves back and forth between positions to either side of, and outside the housing as a function of time as the vibratory generating means imparts the vibratory force to the housing.

11. The workpiece tumbling and conveying apparatus of claim 1, wherein the vibratory generating means is oriented for generating the vibratory force acting at an acute angle to the vertical providing a conveying force component thereof generally along the longitudinal axis of the housing from the inlet toward the outlet thereof.

12. The workpiece tumbling and conveying apparatus of claim 1, wherein:

the elongated housing is inclined from the inlet toward the outlet; and, the vibratory generating means is oriented for generating the vibratory force acting at an acute angle to the vertical providing a conveying force component thereof generally along the longitudinal axis of the housing from the inlet to the outlet thereof.

13. The workpiece tumbling and conveying apparatus of claim 1, wherein:

the elongated housing is inclined from the inlet toward the outlet thereof; and, the vibratory generating means is oriented for generating the vibratory force acting at an acute angle to the vertical providing a conveying force component thereof generally along the longitudinal axis of the housing from the outlet toward the inlet thereof.

14. The workpiece tumbling and conveying apparatus of claim 1, wherein the vibratory generating means is oriented to produce the force couple component with the moment axis of the force couple component generally lateral to the longitudinal axis of the housing and spaced outwardly from the housing.

15. The workpiece tumbling and conveying apparatus of claim 1, wherein the moment axis of the force couple component of the vibratory force is declined from the inlet toward the outlet of the housing relative to the longitudinal axis of the housing to provide a conveying force component thereof generally along the longitudinal axis of the housing in a direction from the inlet toward the outlet of the housing.

16. The workpiece tumbling and conveying apparatus of claim 14, wherein:

the moment axis of the force couple component of the vibratory force is inclined from the inlet toward the outlet of the housing relative to the longitudinal axis of the housing to provide a counter-conveying force component of the vibratory force generally along the longitudinal axis of the housing in a direction from the outlet toward the inlet of the housing; and, the housing is declined from the upstream end toward the downstream end.

17. The workpiece tumbling and conveying apparatus of claim 14, wherein:

the axis of rotation of the first and second eccentric weights are inclined from the inlet toward the outlet of the housing relative to the longitudinal axis of the housing to generate a counter-conveying force component of the vibratory force generally along the longitudinal axis of the housing in a direction from the outlet toward the inlet of the housing; and, the housing is declined from the inlet end toward the upstream end toward the downstream end.

18. The workpiece tumbling and conveying apparatus of claim 1, wherein the vibratory force generating means comprises:

at least one pair of first and second rotatable eccentric weights, the first eccentric weight being located above the second eccentric weight with the axis of rotation of the first and second eccentric weights mutually parallel; and, means for counter-rotating the first and second eccentric weights about their respective axis of rotation such that the first eccentric weight is caused to rotate in one direction and the second eccentric weight is caused to rotate in the opposite direction.

19. The workpiece tumbling and conveying apparatus of claim 18, wherein the axis of rotation of the first eccentric weight and the axis of rotation of the second eccentric weight are in a common plane, the common plane of the axis of rotation being substantially perpendicular to a radius of the arcuate bottom wall of the housing, and the common plane of the axis of rotation being spaced outwardly from and generally to one side of the housing.

20. The workpiece tumbling and conveying apparatus of claim 19, wherein the axis of rotation of the first eccentric weight and the axis of rotation of the second eccentric weight are equally spaced apart to opposite lateral sides of the longitudinal axes of the elongated housing.

21. The workpiece tumbling and conveying apparatus of claim 18, wherein the axis of rotation of the first and second eccentric weights are substantially parallel to the longitudinal axis of the housing.

22. The workpiece tumbling and conveying apparatus of claim 18, wherein the axis of rotation of the first and second eccentric weights are declined from the inlet toward the outlet of the housing relative to the longitudinal axis of the housing to generate a conveying force component of the vibratory force generally along the longitudinal axis of the housing in a direction from the inlet toward the outlet of the housing.

23. The workpiece tumbling and conveying apparatus of claim 18, wherein the vibratory generating means comprises:

a plurality of pairs of first and second rotatable eccentric weights, the pairs of first and second eccentric weights being spaced apart from each other along the length of the elongated housing; and the means for counter-rotating the first and second eccentric weights being interconnected to the plurality of pairs of first and second weights to rotate the first eccentric weights of the plurality of pairs of first and second weights in unison with each other, and to rotate the second eccentric weights of the plurality of pairs of first and second weights in unison with each other.

24. The workpiece tumbling and conveying apparatus of claim 23, wherein:

the axis of rotation of the first eccentric weight and the axis of rotation of the second eccentric weight of each pair of weights are in a common plane, the common plane of the axes of rotation being substantially perpendicular to a radius of the arcuate bottom wall of the housing, and the common plane of the axes of rotation being spaced outwardly from and generally to one side of the housing; and, the common planes of rotation of the first and second weights of all the pairs of first and second weights also being common.

25. The workpiece tumbling and conveying apparatus of claim 24, wherein the axis of rotation of the first and second eccentric weights of each pair of first and second weights are substantially parallel to the longitudinal axis of the housing.

26. The workpiece tumbling and conveying apparatus of claim 24, wherein:

the axis of rotation of the first and second eccentric weights of at least another one of the plurality of pairs of first and second weights are substantially parallel to the longitudinal axis of the housing; and, the axis of rotation of the first and second eccentric weights of at least another one of the plurality of pairs of first and second weights are declined from the inlet toward the outlet of the housing relative to the longitudinal axis of the housing.

27. The workpiece tumbling and conveying apparatus of claim 24, wherein:

the axis of rotation of the first and second eccentric weights of each pair of first and second weights are declined from the inlet toward the outlet of the housing relative to the longitudinal axis of the housing.

28. The workpiece tumbling and conveying apparatus of claim 24, wherein:

the axis of rotation of the first and second eccentric weights of at least one of the plurality of pairs of first and second weights are substantially parallel to the longitudinal axis of the housing; and, the axis of rotation of the first and second eccentric weights of at least one of the plurality of pairs of first and second weights are substantially parallel to the longitudinal axis of the housing; and, the axis of rotation of the first and second eccentric weights of at least another one of the plurality of pairs of first and second weights are inclined from the inlet toward the outlet of the housing relative to the longitudinal axis of the housing.

29. The workpiece tumbling and conveying apparatus of claim 24, wherein:

the axis of rotation of the first and second eccentric weights of each pair of first and second weights are inclined from the inlet toward the outlet of the housing relative to the longitudinal axis of the housing; and, the housing is declined from the upstream end toward the downstream end.

* * * * *